US007198081B2

(12) United States Patent
Lewis et al.

(10) Patent No.: US 7,198,081 B2
(45) Date of Patent: Apr. 3, 2007

(54) LOG SPLITTER

(75) Inventors: Christopher J. Lewis, Anderson, SC (US); Taku Ohi, Greer, SC (US); Charles K. Long, Seneca, SC (US); Kenneth M. Brazell, Piedmont, SC (US); Marion Reynolds, Anderson, SC (US)

(73) Assignee: Eastway Fair Company Limited, Tortola (VG)

( * ) Notice: Subject to any disclaimer, the term of this patent is extended or adjusted under 35 U.S.C. 154(b) by 0 days.

(21) Appl. No.: 11/030,563

(22) Filed: Jan. 4, 2005

(65) Prior Publication Data

US 2006/0144468 A1 Jul. 6, 2006

(51) Int. Cl.
*B27L 7/06* (2006.01)

(52) U.S. Cl. ..... 144/195.8; 173/90

(58) Field of Classification Search ..... 144/193.1, 144/193.2, 195.1, 195.7, 195.8, 286.1, 287, 144/286.5; 173/90, 91; 254/104; 108/122, 108/130, 146, 153.1, 158.11; 83/870–874, 83/438, 449; 248/168.2, 188.8; 280/47.24
See application file for complete search history.

(56) References Cited

U.S. PATENT DOCUMENTS 1,150,038 A 8/1915 Kent
3,176,320 A * 4/1965 Miret ..... 5/3
3,862,651 A 1/1975 Heikkinen
4,258,764 A * 3/1981 Gerst ..... 144/193.1
4,353,401 A 10/1982 Schilling
4,366,848 A * 1/1983 Gavinski ..... 144/195.1
4,446,898 A 5/1984 Manteufel
4,454,902 A * 6/1984 Larger ..... 144/366
4,457,399 A 7/1984 Breisch
4,483,379 A 11/1984 Aikins et al.
4,498,293 A * 2/1985 Gregory ..... 60/478
4,553,576 A 11/1985 Maingueneau
4,655,269 A 4/1987 Hanser et al.
4,756,384 A 7/1988 Maddox
4,790,168 A 12/1988 Vonthien
5,460,211 A 10/1995 Minati
5,472,029 A * 12/1995 Ketch ..... 144/371
5,492,159 A 2/1996 Maloshicky
5,839,540 A 11/1998 Russell
5,921,299 A * 7/1999 Liu ..... 144/195.1
6,386,249 B1 5/2002 Murphy
6,640,930 B1 11/2003 Peters et al.

* cited by examiner

*Primary Examiner*—Shelley Self
(74) *Attorney, Agent, or Firm*—Brinks Hofer Gilson & Lione; G. Peter Nichols

(57) ABSTRACT

A portably log splitter is provided. The log splitter comprises a base having a pair of one-piece side members, and a support member to which the one-piece side members are attached. The support member and the one-piece side members form a seat that is adapted to receive a log. The log splitter also includes a splitting wedge that is attached to the support member and a contact member that is configured to translate in a reciprocal manner adjacent to the support member in order to move the log. The log splitter also includes a control assembly operated by a switch to actuate the contact member in the reciprocal manner.

15 Claims, 8 Drawing Sheets

LOG SPLITTER

FIELD OF THE INVENTION

This invention relates generally to a log splitter, and more specifically, to a portable log splitter.

BACKGROUND

Conventional log splitting devices are used in order to reduce large logs into smaller logs that are more portable. It is common for these log splitting devices to employ hydraulic systems to move a wedge toward a log or to move the log toward a stationary wedge in order to split the log. These hydraulic systems are often bulky, thereby causing the device to be heavy and awkward when trying to move the log splitting device between locations. Typical devices that allow for the portability of a log splitter are connected directly to the structural framework, but the typical portability devices provide poor structural support system for log splitting devices.

Large logs are very heavy and are typically odd-shaped such that balancing a log on a conventional log splitting device is difficult. The support structure for these conventional log splitting devices does not provide sufficient support to allow for a heavy log having a variable shape to be adequately placed on the log splitting device in a stable manner without tipping the log splitting device or the log rolling off before being cut. The typical support structure that maintains the log in a desired position, or allows the log to translate, is generally not sufficient to support logs having a heavy weight.

It is therefore desirable to have a log splitting device that is easily portable between different locations and provides a stable foundation. It is further desirable to have an improved log splitting device that is able to support large logs on the log splitting device without tipping yet able to prevent the log from rolling off.

BRIEF SUMMARY

The present invention solves one or more of the shortcomings above by providing a pair of one-piece side members that, in conjunction with a support member, form a seat adapted to receive a log. The embodiments described herein allow for a cost-effective log splitter being more stable than conventional log splitting devices. Such improvements greatly increase the safety and ease of portability for the log splitter.

In one aspect of the invention, a log splitter is provided. The log splitter includes a base having a pair of one-piece side members. The one-piece side members are attached to a support member that is located between the one-piece side members. The one-piece side members and the support member form a seat that is adapted to receive a log. A splitting wedge is operably connected to the support member. A contact member is configured to translate in a reciprocal manner along the length of the support member in order to move the log. A control assembly, operated by a switch, is configured to actuate the contact member in the reciprocal manner.

In another aspect of the invention, a method for splitting a log is provided. The method includes providing a splitting wedge that is operably connected to a support member. A pair of one-piece side members are connected to the support member to form a base, and the support member and the one-piece side members form a seat that is adapted to receive a log. The method further includes moving a contact member toward the splitting wedge in order to cut the log. Furthermore, the contact member is configured to move in a reciprocal manner adjacent to the support member.

Advantages of the present invention will become more apparent to those skilled in the art from the following description of the preferred embodiments of the invention which have been shown and described by way of illustration. As will be realized, the invention is capable of other and different embodiments, and its details are capable of modification in various respects.

Accordingly, the drawings and description are to be regarded as illustrative in nature and not as restrictive.

DETAILED DESCRIPTION OF THE DRAWINGS AND THE PRESENTLY PREFERRED EMBODIMENTS

Figure 1:
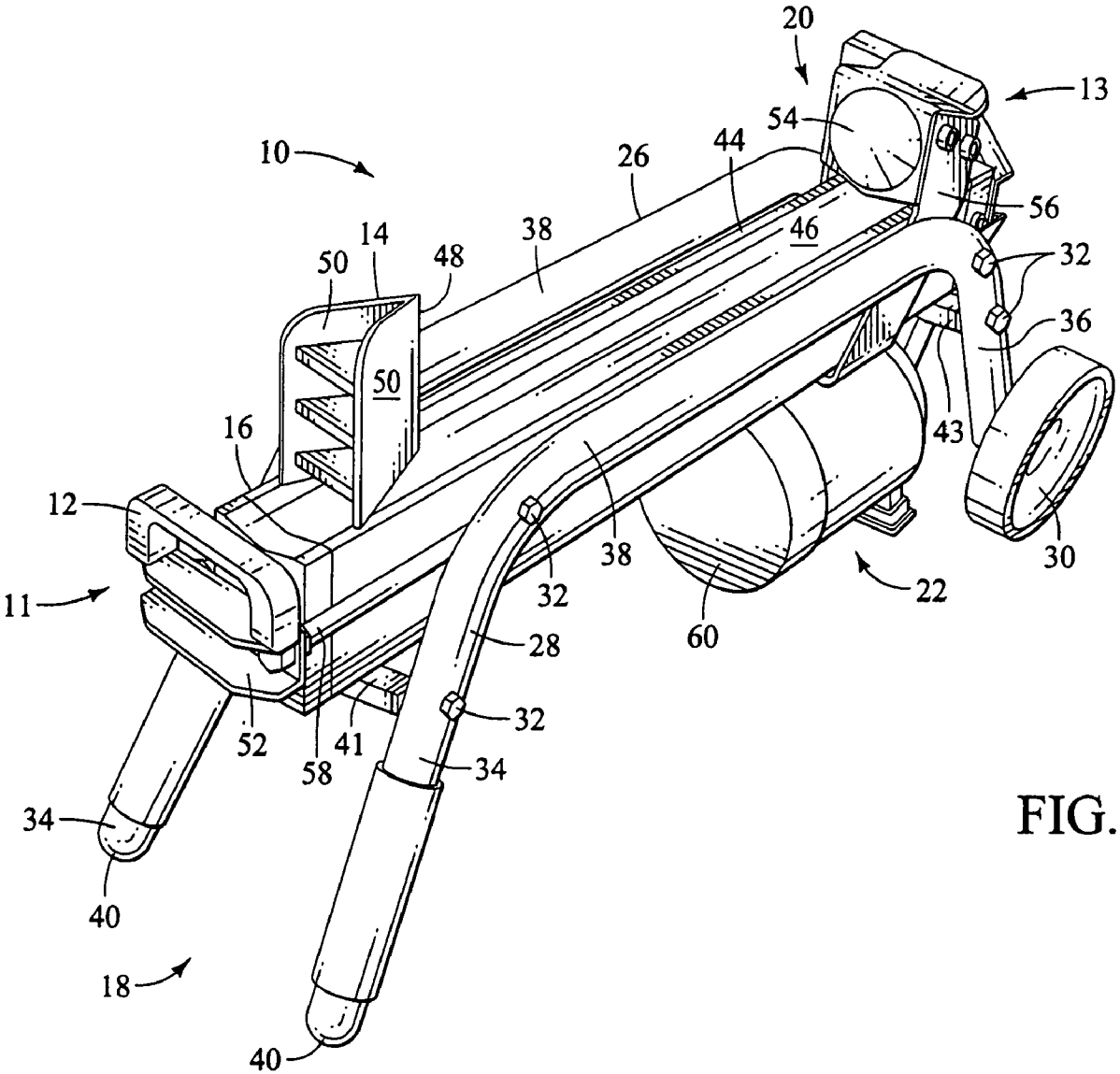
FIG. 1 is a top perspective of one embodiment of a log splitter.
Figure 2:
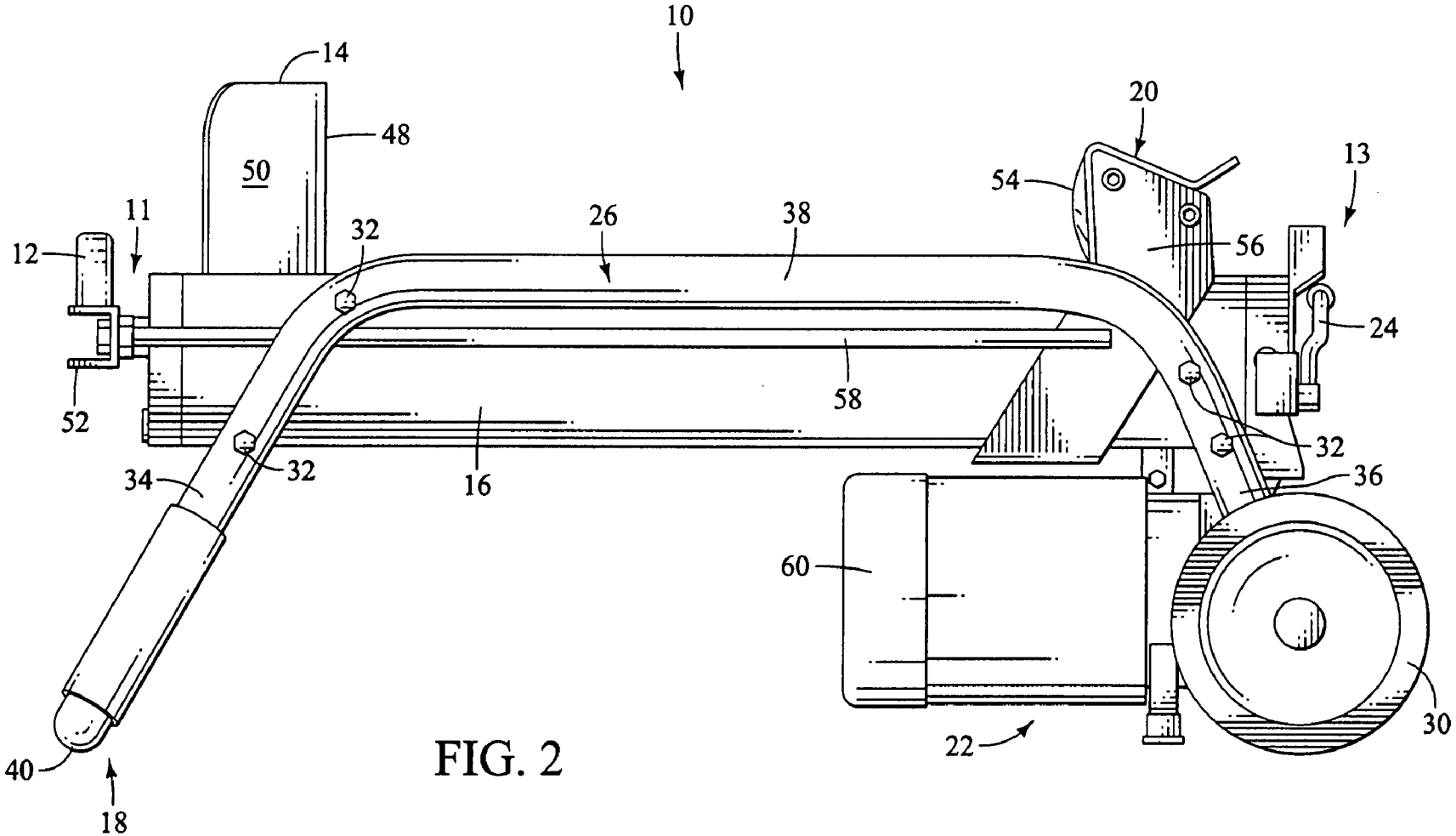
FIG. 2 is a right side view of the log splitter of FIG. 1.
Figure 3:
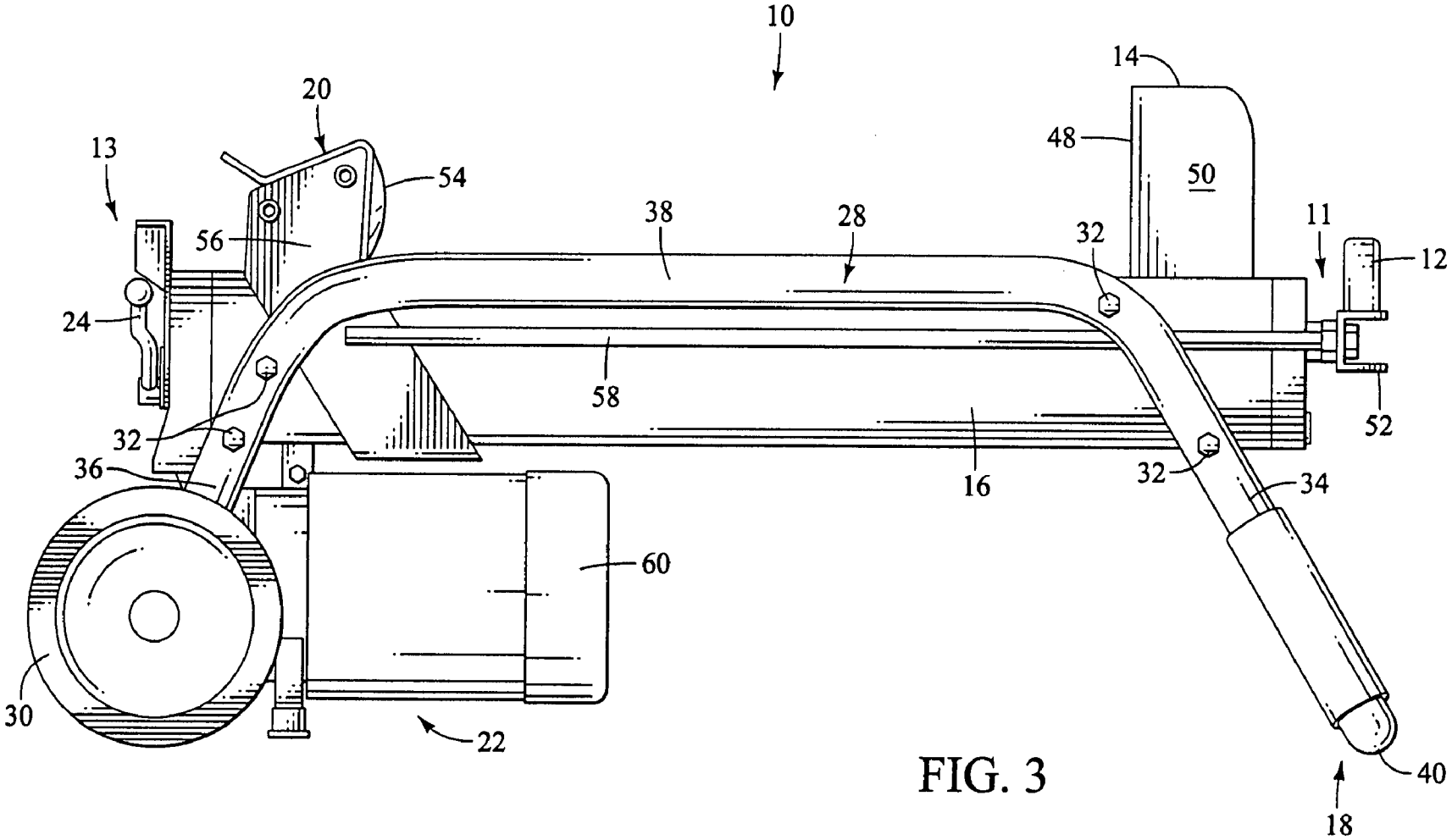
FIG. 3 is a left side view of the log splitter of FIG. 1.

Referring to FIGS. 1–2, one embodiment of a log splitter 10 of the present invention is shown. The log splitter 10 includes a handle 12, a splitting wedge 14, a support member 16, a base 18, a guide assembly 20, a control assembly 22, and a switch 24. Preferably, the handle 12 is located at the forward end 11 of the log splitter 10 and the switch 24 is located at the rearward end 13 of the log splitter 10 such that the switch 24 is disposed near the control assembly 22. The handle 12 is preferably located at the end opposite the switch 24 and the control assembly 22 such that the log splitter 10 is more readily moveable by allowing the user to lift the lighter end of the log splitter 10.

In the preferred embodiment, the base 18 includes a first side member 26, a second side member 28, and a wheel 30 attached to each side member 26, 28, as illustrated in FIGS. 1–2. The side members 26, 28 form a foundation for the log splitter 10 such that during the transport and operation, the log splitter 10 remains stable. The side members 26, 28 are located on opposing sides of the support member 16, and are oriented such that the side members 26, 28 are disposed adjacent to the side surfaces of the support member 16 that extends along the length of the log splitter 10. The side members 26, 28 are preferably attached to the support member 16 by way of a plurality of bolts 32. However, it should be understood by one skilled in the art that the side members 26, 28 can be connected to the support structure by any means including, but not limited to, welding, rivets, or any combination thereof.

In the preferred embodiment, each side member 26, 28 is preferably a one-piece member and made of a hollow tube forming a front leg 34, a rear leg 36, and a center section 38, as illustrated in FIG. 2. The center section 38 is configured to extend in a substantially parallel manner relative to the side surfaces of the support member 16, and the legs 34, 36 are configured to extend from the center section 38 at an angle thereto. In the preferred embodiment, each side member 26, 28 is formed from a single tube, but it should be understood by one skilled in the art that the front leg, rear leg, and center section can each be formed by individual members that are attached to form a single one-piece side member 26, 28. Furthermore, the tube forming the side members 26, 28 is preferably hollow, but it should be understood by one skilled in the art that a solid tube can also be used. The tubes of the side members 26, 28 are preferably made of steel, but any other material sufficient to withstand the loads applied to the log splitter can be used.

Figure 8:
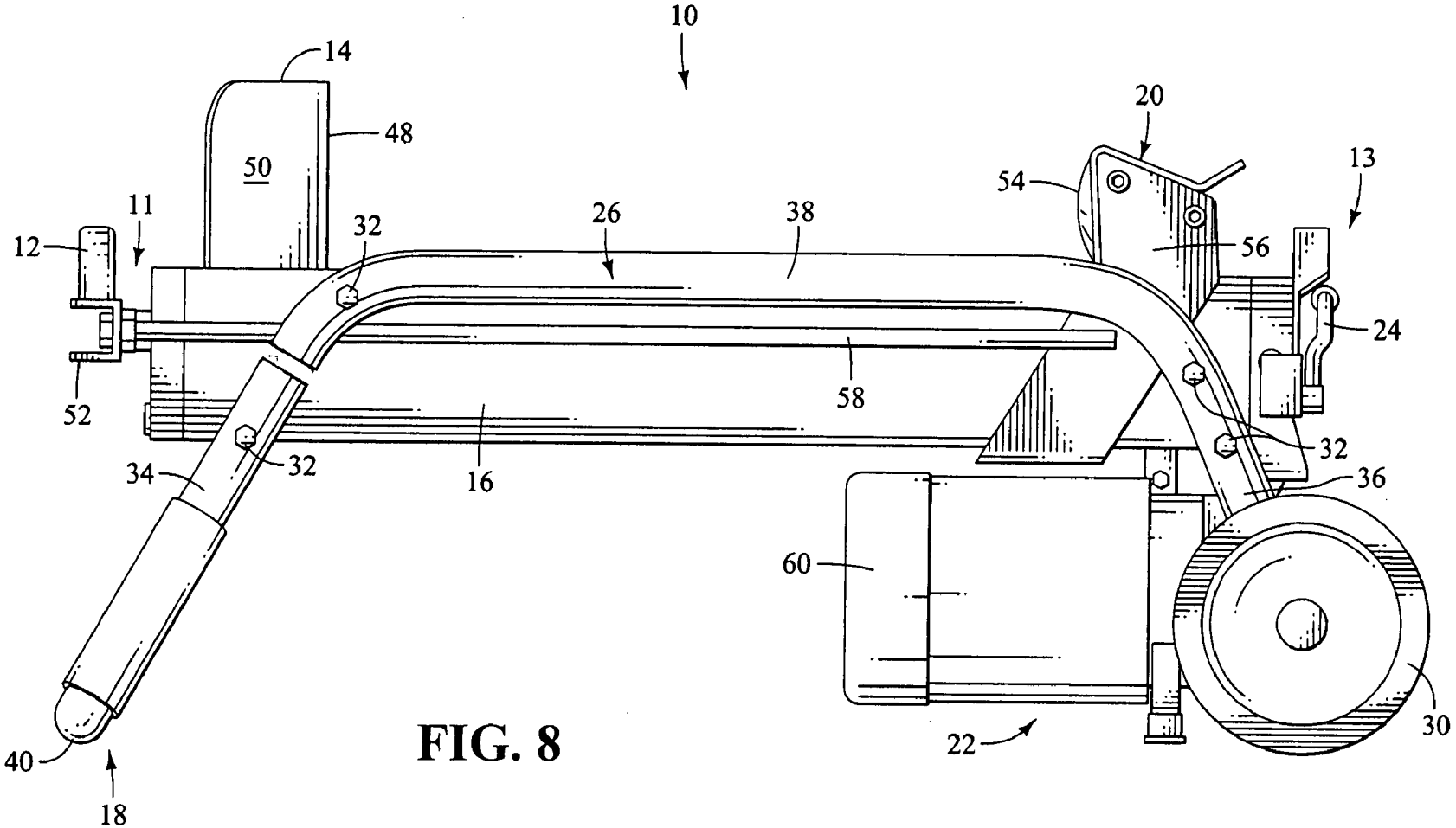
FIG. 8 is a right side view of a second embodiment of the log splitter.
Figure 9:
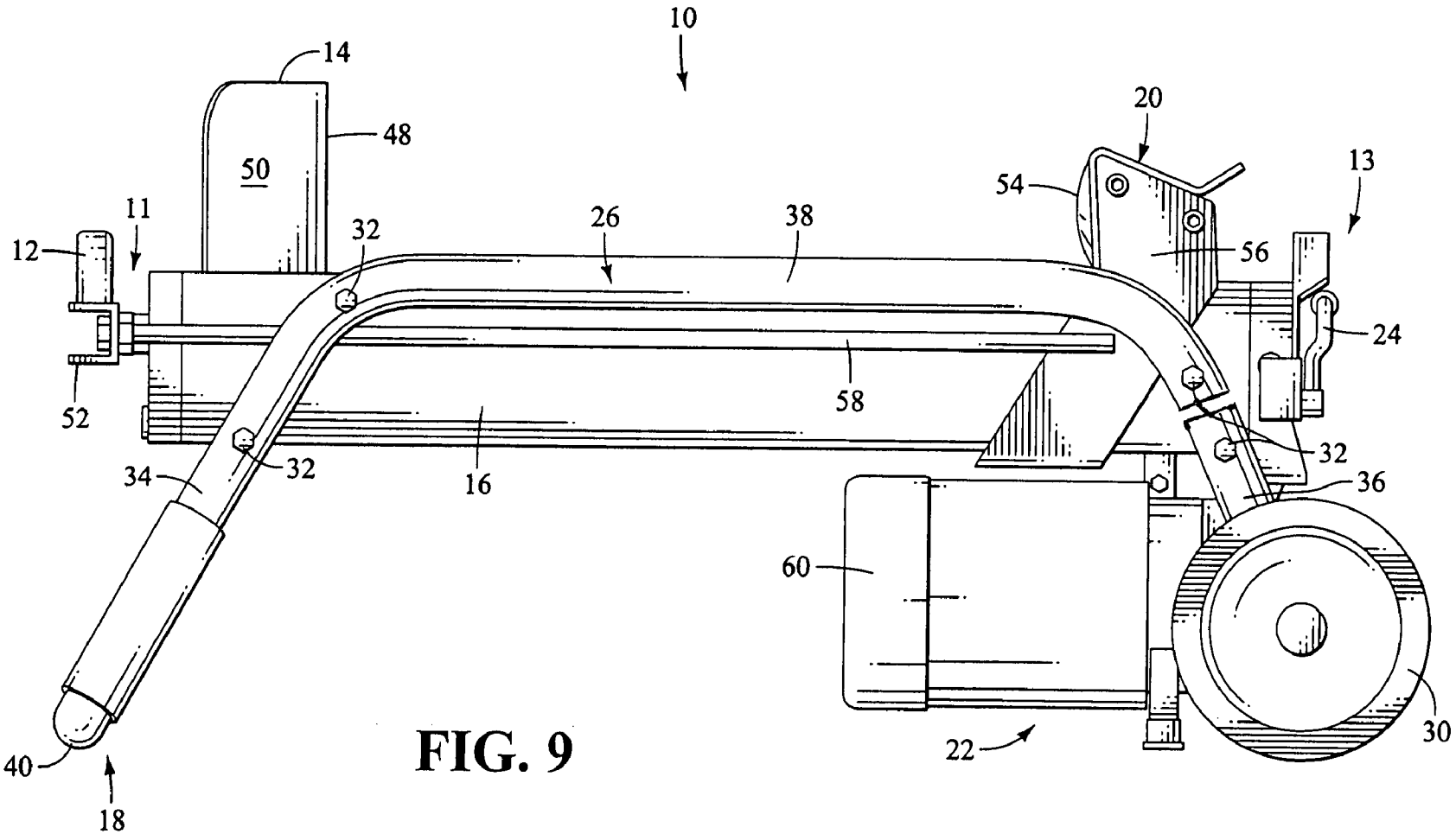
FIG. 9 is a right side view of a third embodiment of the log splitter.

In an alternative, each side member 26, 28 can be a one-piece member forming a center section 38 and a rear leg 36, as illustrated in FIG. 8. The front leg 34 is attached directly to support member 16 without being attached to the one-piece side members 26, 28. In a further alternative embodiment, each side member 26, 28 can be a one-piece member forming a center section 38 and a front leg 34, as illustrated in FIG. 9. The rear leg 36 is attached directly to support member 16 without being attached to the one-piece side members 26, 28. It should be understood by one skilled in the art that each one-piece side member can include a center section 38 in combination with a front leg 34 and a rear leg 36, a center section 38 in combination with only a front leg 34, or a center section 38 in combination with only a rear leg 36. It should also be understood by one skilled in the art that a side member can include a different combination of legs with the center section than the opposing side member.

Both the front leg 34 and rear leg 36 of each of the side members 26, 28 extend downward from the center section 38 at an angle of between about fifteen and one hundred sixty five degrees (15–165°). The front leg 34 preferably extends from the center section 38 such that the included angle between the front leg 34 and the center section 38 is about one hundred twelve degrees (112°), and the rear leg 36 preferably extends from the center section 38 such that the included angle between the rear leg 36 and the center section 38 is about one hundred ten degrees (110°). The legs 34, 36 provide a base upon which the forward end 11 and rearward end 13 of the log splitter 10 contact the ground. The end 40 of each front leg 34 opposite the connection between the front leg 34 and the center section 38 is configured to contact the ground is preferably rounded. In an alternative embodiment, the distal end 40 of the front leg 34 is capped. A wheel 30 is preferably attached to the distal end 42 of each rear leg 36 opposite the connection between the rear leg 36 and the center section 38. The wheels 30 allow the log splitter 10 to be easily transferred from one location to another by way of rolling the apparatus on the wheels 30. In an alternative embodiment, a wheel is attached to the ends of both legs of the side members, thereby allowing the user to roll the log splitter along the ground without lifting either end.

Figure 5:
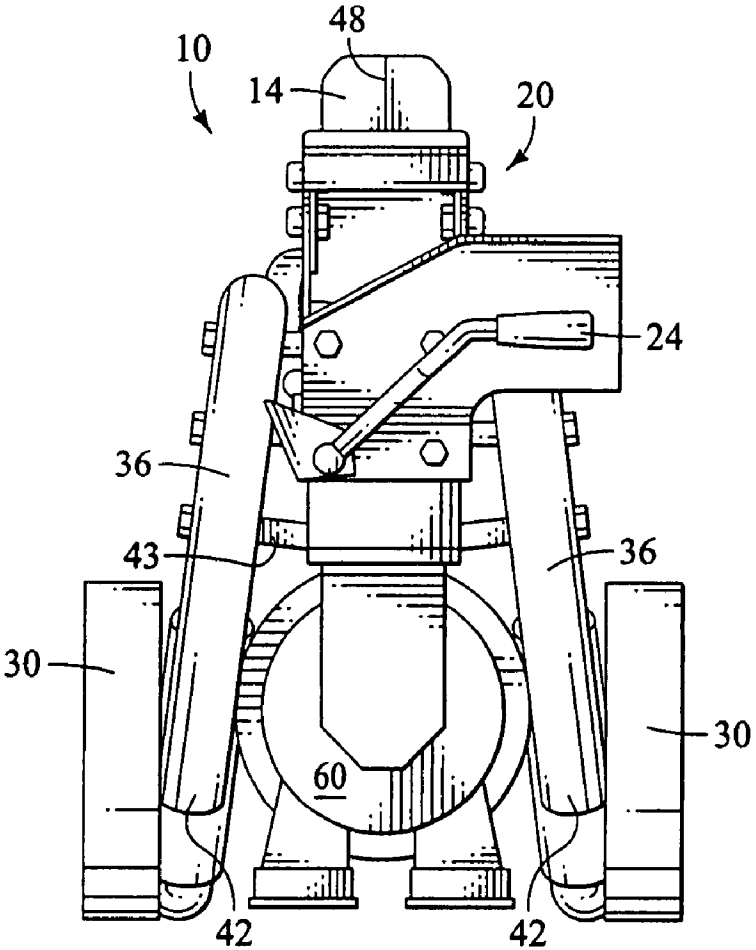
FIG. 5 is a rear view of the log splitter of FIG. 1.
Figure 4:
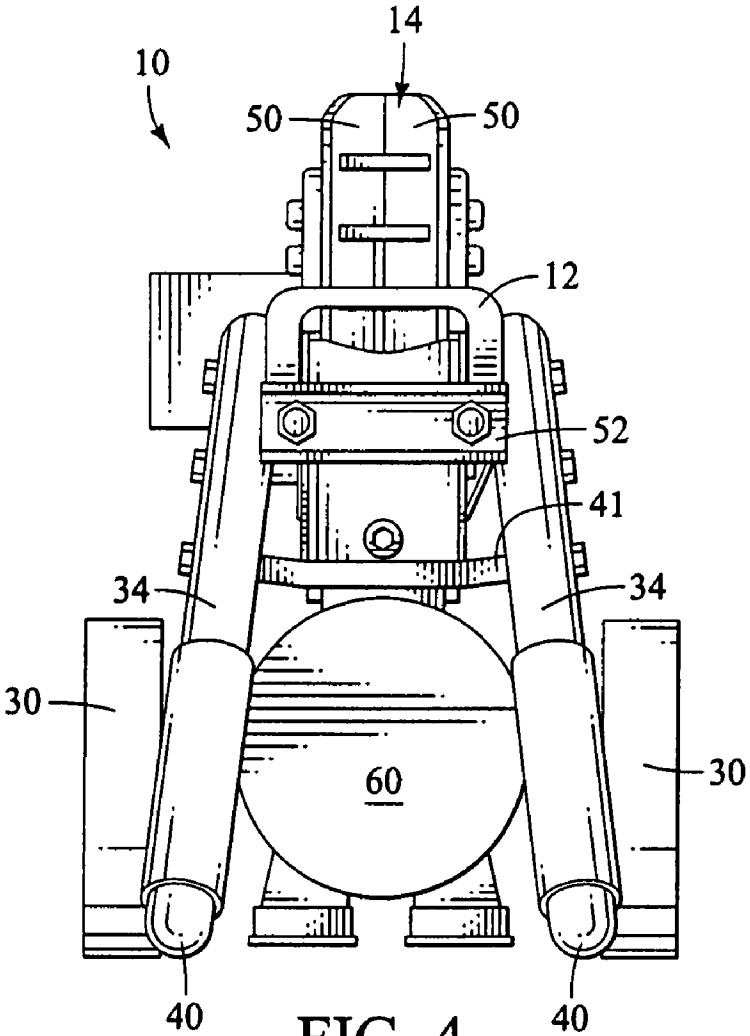
FIG. 4 is a front view of the log splitter of FIG. 1.
Figure 6:
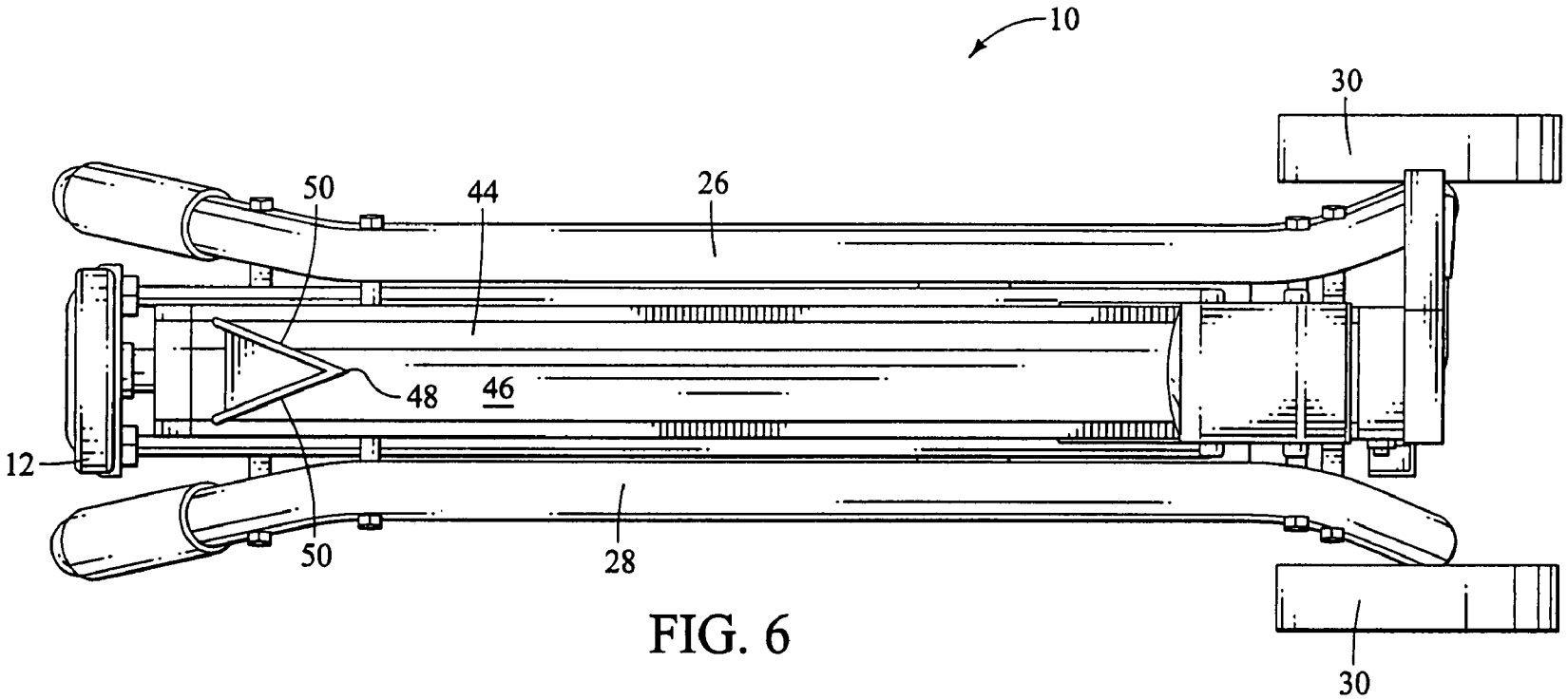
FIG. 6 is a top view of the log splitter of FIG. 1.
Figure 7:
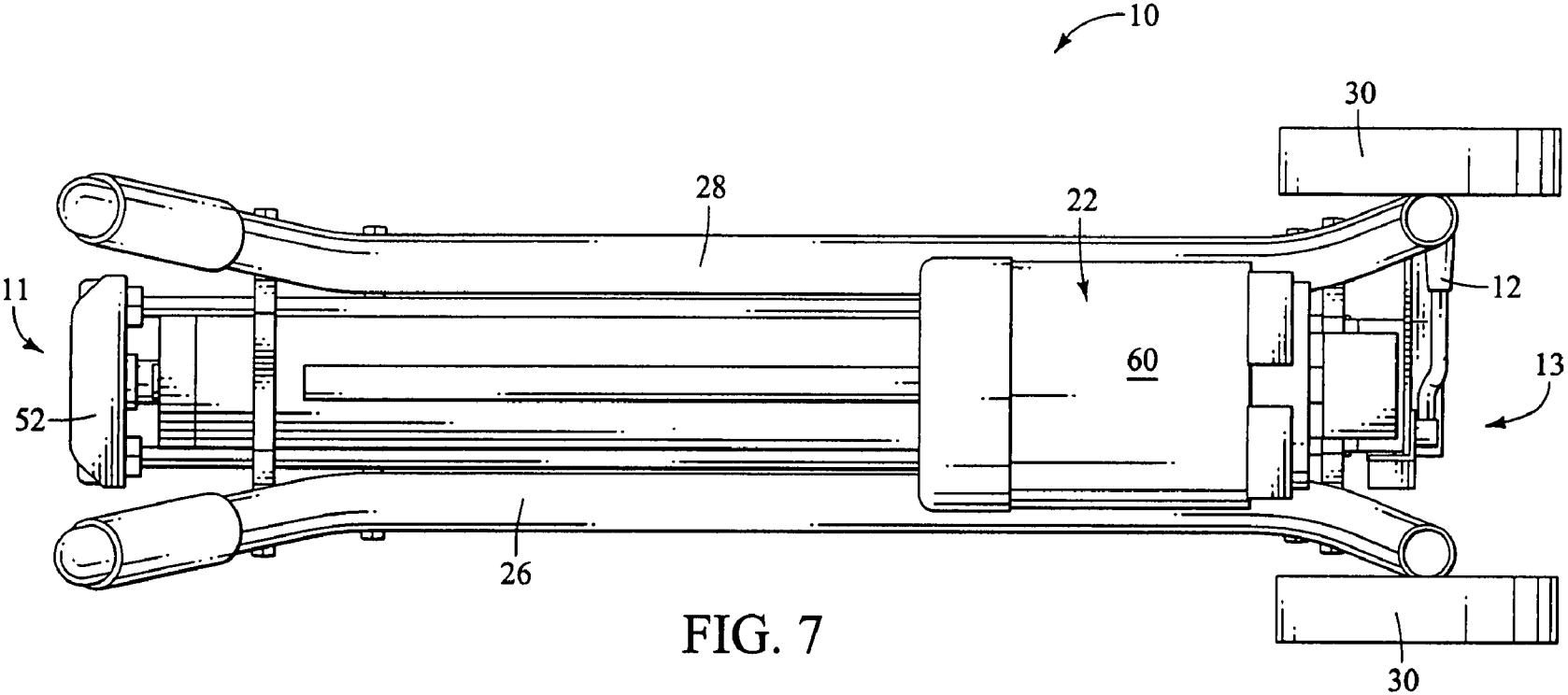
FIG. 7 is a bottom view of the log splitter of FIG. 1.

As the front legs 34 extend downward from the center section 38, the front legs 34 also extend outward away from the support member 16, as illustrated in FIG. 4. As illustrated in FIG. 5, the rear legs 36 likewise extend in an outward direction away from the support member 16 as the rear legs 36 extend downward from the center sections 38. Because the ends 40, 42 of the legs 34, 36 extend in an outward direction away from the support member 16, the legs 34, 36 provide a more stable base upon which the log splitter 10 rests by having a more stable footprint in the lateral direction. The distance between the ends 40 of the front legs 34 is between about seven and twelve inches (7–12"), and preferably is about eight and one-quarter inches (8¼"). The distance between the ends 42 of the rear legs 36 is between about seven and twelve inches (7–12"), and preferably is about eight inches (8"). The footprint of the log splitter 10 provides an advantage over conventional log splitters by making the log splitter more stable.

The front legs 34 are connected by a first cross tie 41 located below the support member 16, and the rear legs 36 are connected by a second cross tie 43 also located below the support member 16. These cross ties 41, 43 provide additional structural support to the base 18 by preventing outward deflection of the legs 34, 36 away from support member 16 when a large log is placed upon the log splitter 10. The cross ties 41, 43 ensure that the base 18 remains stable so as to prevent the log splitter from tipping.

The support member 16, as shown in FIG. 1, provides a structural framework to the log splitter 10, and further provides a structure to which other components of the log splitter are connected. In one embodiment, the support member 16 is formed of a substantially rectangular tube having a square cross-section. The top surface 44 of the support member 16 includes an inward-directed indentation 46 along the entire length of the support member. This indentation 46 is configured to receive a log placed on the top surface 44 of the support member 16 and between the center section 38 of the opposing side members 26, 28. The center sections 38 of the opposing side members 26, 28 are preferably spaced apart by about 6 inches (6"). However, it should be understood by one skilled in the art that the center sections 38 of the opposing side members 26, 28 can be any distance sufficient to receive a log and provide a stable base for the log splitter 10. The top surface 44 is preferably disposed below the upper edge of the center sections 38, such that the shape of the indentation 46 of the top surface 44 and the center sections 38 of the opposing side members 26, 28 form a generally rounded seat, or recess, to support a log on the log splitter 10.

The side members 26, 28 are spaced apart from the support member 16, as shown in FIG. 1, thereby allowing a greater lateral support for a log. The side members 26, 28 and the support member 16 form a seat in which a log can be placed. It should be understood by one skilled in the art that a log placed on the spaced apart side members 26, 28 may have a diameter or a particular shape such that the log does not contact the top surface 44 of the support member 16, yet the top surface 44 of the support member 16 remains configured to receive and support a log. Because the side members 26, 28 and the top surface 44 of the support member 16 are configured to receive the log, the spaced-apart side members 26, 28 provide for more lateral support such that more surface area of the log is disposed on the log splitter 10. The increased lateral support, in combination with the more stable footprint of the base 18, provides the log splitter 10 with a stable support structure upon which a log is placed.

The side members 26, 28 are configured to provide the log splitter 10 with a stable base as well as provide structural support for receiving a log. While the legs 34, 36 contact the ground and maintain the operating mechanisms of the log splitter 10 a safe distance above the ground, the center section 38 of the side members 26, 28 receive the weight of a log and transmit the weight through the legs 34, 36 to the ground. Conventional log splitters have legs that are directly attached to the structural framework of the apparatus, and separate guide members are attached to the structural framework in order to receive the weight of the log. Another advantage of the present invention is that the one-piece side members 36, 38 provide both a stable base as well as a structural support for receiving and transmitting the loads of a log. A further advantage of the present invention over conventional log splitting devices is that the one-piece structure of the side members 36, 38 requires fewer parts and less tooling than conventional log splitters, thereby reducing the costs associated with manufacturing a log splitter.

The splitting wedge 14 is operably connected to the top surface 44 of the support member 16, as illustrated in FIG. 1. The splitting wedge 14 is a wedge-shaped member having a vertical edge 48 directed toward the longitudinal direction of the log splitter 10 such that the vertical edge 48 is configured to contact and cut a log. The splitting wedge 14 has a pair of side pieces 50 that extend from the vertical edge 48 and form an angle therebetween. The angle formed between the side pieces 50 can vary depending upon the application of the log splitter 10. The preferred angle formed by the side pieces 50 is between about thirty and fifty-five degrees (30–55°). Splitting wedges are not new to the art, and as such, it should be understood by one skilled in the art that any splitting wedge sufficient to cut wood can be used.

In the preferred embodiment, the splitting wedge 14 is rigidly attached to the support member 16 such that the movement of the guide assembly 20 causes the log to move toward the splitting wedge 14 to be cut. However, it should be understood by one skilled in the art that the present log splitter can be configured such that the guide assembly remains stationary as the splitting wedge is caused to be actuated in order to cut the log. The splitting wedge 14 is preferably welded to the top surface 44 of the support member 16, but any other means of attaching the splitting wedge to the support member sufficient to withstand the loads during the operation of the log splitter can be used.

The guide assembly 20 includes a c-bracket 52, a contact member 54, a pair of brackets 56, and a pair of rods 58, as illustrated in FIGS. 1–4. The guide assembly 20 is configured to actuate the contact member 54 toward and away from the stationary splitting wedge 14 in a translational manner by way of reciprocal movement relative to the longitudinal direction of the support member 16. In an alternative embodiment, the guide assembly includes a splitting wedge that is configured to be actuated toward a stationary contact member. In a further alternative embodiment, the guide assembly includes a splitting wedge that is configured to be actuated toward a stationary splitting wedge such that both ends of a log are cut by a splitting wedge. The contact member 54 has a pair of brackets 56 attached to opposing sides thereof. The brackets 56 extend along the vertical sides of the contact member 54 and around the bottom of the support member 16 where adjacent edges of the brackets 56 are attached to each other. The c-bracket 52 is located adjacent to the forward end 11 of the log splitter 10, and operably connected to the brackets 56 by way of a pair of rods 58. The rods 58 are disposed between the side members 26, 28 and the support member 16 such that as the contact member 54 is actuated in the reciprocal manner, the brackets 56 remain between the side members 26, 28 and the support member 16.

The handle 12 is connected to the c-bracket 52, as illustrated in FIGS. 1 and 4. The handle 12 is configured to allow the user to grasp the handle 12 and lift the forward end 11 of the log splitter 10 away from the ground. The handle 12 and c-bracket 52 are configured to actuate as the contact member 54 translates toward the splitting wedge 14. However, it should be understood by one skilled in the art that the handle can be configured to be attached directly to the support member. In an alternative embodiment, a plurality of handles extend from a proximal point connected to the support member such that the handles are configured in a wheelbarrow-type manner.

The control assembly 22 is configured to actuate the guide assembly 20 in order to cut a log. The control assembly 22 includes a motor 60 operatively connected to at least one cylinder (not shown). The cylinder is disposed within the support member 16 and is configured to extend and retract a push arm, thereby actuating the contact member 54 toward and away from the splitting wedge 14. In the preferred embodiment, the motor 60 and cylinder form a hydraulic system. In an alternative embodiment, the cylinder is air-operated by the motor. It should be understood by one skilled in the art that any other actuating means sufficient to actuate the guide assembly so as to cut a log can be used. In the preferred embodiment, the cylinder is connected to the c-bracket 52 located at the forward end 11 of the log splitter 10. The operative stroke of the cylinder is sufficient to allow the contact member 54 to be actuated between a first operative position and a second operative position. When in the first operative position, the contact member 54 is located adjacent to the rearward end 13 of the log splitter 10, and when in the second operative position, the contact member 54 is in contact with the vertical edge 48 of the splitting wedge 14. The motor 60 is operated by way of a moveable switch 24, as illustrated in FIG. 5, which is manually controlled by a user.

In operation, the user moves the switch 24 from a first position to a second position, thereby causing the motor 60 to operate the cylinder such that the guide assembly 20 moves in a manner in which the c-bracket 52 extends away from the support member 16 and the contact member 54 translates from the first operative position toward the splitting wedge 14 by way of the rods 58 that connect the c-bracket 52 and the brackets 56 to the contact member 54. The cylinder is operable such that the contact member 54 can assume any point between the first operative position and the second operative position. Once the log is split, the user moves the switch 24 to a third position, thereby causing the motor to operate the cylinder such that the guide assembly 20 moves in a manner in which the contact member 54 translates in a direction away from the splitting wedge 14. When the switch is returned to the first position, the motor is stopped, thereby preventing the cylinder from operating.

In an alternative embodiment, the guide assembly is configured to be spring-loaded such that the contact member begins at a location adjacent to the splitting wedge, and the operator moves the switch to cause the cylinder to actuate the contact member away from the splitting wedge. Once there is sufficient space, a log is placed between the contact member and the splitting wedge. The operator then directs the cylinder to actuate the contact member to the furthest point from the splitting wedge. The operator then pushes a button (not shown) that causes the contact member to rapidly translate toward the splitting wedge, thereby cutting the log.

In a further alternative embodiment, the cylinder is configured to actuate a spring-loaded splitting wedge away from a stationary contact member in the same manner as the spring-loaded contact member previously discussed. When the operator pushes the button, the splitting wedge rapidly translates toward the contact member, thereby cutting the log.

While preferred embodiments of the invention have been described, it should be understood by one skilled in the art that the invention is not so limited and modifications may be made without departing from the invention. The scope of the invention is defined by the appended claims, and all devices that come within the meaning of the claims, either literally or by equivalence, are intended to be embraced therein.

The invention claimed is:

1. A log splitter comprising:

a support member having a top surface, two opposing side surfaces extending from the top surface, a front portion and a rear portion, wherein the support member is adapted to receive a log;

a first leg assembly provided on a first side surface and including a first front leg, a first rear leg, and a center section extending from the front portion toward the rear portion and connecting the first front leg and the first rear leg;

a second leg assembly provided on a second side surface and including a second front leg, a second rear leg, and a center section extending from the front portion toward the rear portion and connecting the second front leg and the second rear leg, wherein the center section of the first leg assembly and the center section of the second leg assembly lie in substantially the same horizontal plane, which is disposed above the top surface of the support member;

a splitting wedge operably connected to said support member;

a contact member configured to translate in a reciprocal manner adjacent to said support member in order to move said log; and a control assembly, wherein said control assembly is configured to actuate said contact member in said reciprocal manner.

2. The log splitter of claim 1, wherein said center section of each of first and second leg assembly is disposed adjacent to opposing sides of said support member.

3. The log splitter of claim 2, wherein said front leg of each of the first and second leg assembly extends downward and away from said support member.

4. The log splitter of claim 3, wherein said front legs are connected by a first cross tie.

5. The log splitter of claim 1, wherein said rear leg of each of the first and second leg assembly extends downward and away from said support member.

6. The log splitter of claim 5, wherein a wheel is rotatably connected to an end of said rear leg of each of the first and second leg assembly.

7. The log splitter of claim 1 further comprising a handle operatively connected to said support member.

8. The log splitter of claim 1, wherein said control assembly includes a motor and at least one cylinder.

9. The log splitter of claim 8, wherein said cylinder is air operated.

10. The log splitter of claim 8, wherein said cylinder is hydraulically operated.

11. A log splitter comprising:

a splitting wedge operably connected to a support member, wherein said support member includes a top surface, two opposing side surfaces extending from the top surface, a front portion and a rear portion;

a first leg assembly provided on a first side surface and including a first front leg, a first rear leg, and a center section extending from the front portion toward the rear portion and connecting the first front leg and the first rear leg;

a second leg assembly provided on a second side surface and including a second front leg, a second rear leg, and a center section extending from the front portion toward the rear portion and connecting the second front leg and the second rear leg, wherein the center section of the first leg assembly and the center section of the second leg assembly lie in substantially the same horizontal plane, which is disposed above the top surface of the support member; and a guide assembly configured to translate toward and away from said splitting wedge, wherein one of the support member or the first and second leg assembly support a log.

12. The log splitter of claim 11, wherein a wheel is attached to an end of each of the first and second rear leg.

13. The log splitter of claim 12, wherein a handle is operatively connected to said support member, and said handle is configured to allow a user to lift at least one end of said support member.

14. The log splitter of claim 11, wherein said guide assembly comprises a contact member, a pair of brackets, a pair of rods, and a c-bracket, wherein said pair of brackets are connected to opposing sides of said contact member and said pair of brackets being connected to each other, and said rods extending substantially parallel to said support member.

15. The log splitter of claim 14, wherein said c-bracket is operably connected to a cylinder having an operative stroke such that said contact member is movable between a first operative position and a second operative position.

* * * * *